US005669243A

United States Patent [19]

Drown

[11] Patent Number: 5,669,243

[45] Date of Patent: Sep. 23, 1997

[54] JEWELRY CONSTRUCTION

[76] Inventor: Gerald Drown, 4678 E. Coachlight La., Tucson, Ariz. 85718

[21] Appl. No.: 691,372

[22] Filed: Aug. 2, 1996

[51] Int. Cl.[6] ..... A44C 13/00

[52] U.S. Cl. ..... 63/33

[58] Field of Search ..... 63/12, 13, 14.1, 63/15, 1.1, 2; 29/896.4, 896.41, 284, DIG. 30; 446/220, 226

[56] References Cited

U.S. PATENT DOCUMENTS 4,077,588 3/1978 Hurst ..... 244/31

*Primary Examiner*—Kien T. Nguyen

[57] ABSTRACT

An improved method of constructing jewelry and other ornamental items in which the wall construction is significantly reduced due to internal envelopes or packets of pressurized gas. The packets of pressurized gas provide structural support for the surrounding walls permitting the walls to be thinner than the prior art. Manufacture of the jewelry is accomplished by creating the envelopes and sealing them either in raised pressure environment or later. Pressurization of an envelope is accomplished through different methodologies including: the insertion of a needle through the envelope's wall, pressurization of the interior of the envelope, removal of the needle, and then sealing of the hole created by the needle; through the use of pressurized spheres which are placed within the envelope during manufacture and then rupturing of the pressurized spheres after the envelope has been sealed; or using and then sealing a channel for pressurizing the internal envelope.

11 Claims, 6 Drawing Sheets

JEWELRY CONSTRUCTION

BACKGROUND

This invention relates generally to jewelry and more important to a method of making such.

A significant cost in the manufacture of jewelry is the raw material itself. Precious metals are extremely expensive and their costs are only expected to increase.

The difficulty lies in the manufacture of the items themselves. While a particular article of jewelry has areas or zones which could be "hollowed" to reduce the precious metal required, this approach has a natural limit since the wall depth around the "hollowed" area must be sufficient to withstand external forces created during normal use.

To compensate, excessive amounts of metal are used. The resulting item of jewelry, especially ear-rings, are so heavy that their weight damages the ear-lobe.

It is clear that anything that can decrease the weight of such metals used in jewelry, while keeping the structural integrity of the jewelry, is a benefit to the industry.

SUMMARY OF THE INVENTION

The present invention creates an improved method of manufacturing jewelry and other ornamental items in which wall construction is significantly reduced due to internal envelopes or packets of pressurized gas.

Envelopes are created within the article of jewelry for the purpose of being pressurized above ambient conditions. This pressurization provides a force against the surrounding walls to provide support for the walls from external forces from the ambient air pressure and from other sources.

The packets of pressurized gas provide structural support for the surrounding walls permitting the walls to be thinner than the prior art. The thinner walls this invention affords allows for a vastly reduced amount of precious metals; this significantly reduces the expense in the manufacture of the jewelry.

Manufacture of the jewelry is accomplished by creating the envelopes and sealing them either in raised pressure environment or later. The heightened air pressure is chosen to fit the application of the jewelry although it has been found a one to five pound differential is satisfactory for most conditions.

Pressurization of the envelope is accomplished through different methodologies including: the insertion of a needle through the envelope's wall, pressurization of the interior of the envelope, removal of the needle, and then sealing of the hole created by the needle; or through the use of pressurized spheres which are placed within the envelope during manufacture and then rupturing of the pressurized spheres after the envelope has been sealed.

The preferred method employs an air channel which extends external to the jewelry. A pressure source, such as a small hose, is attached to the air channel and the envelope is pressurized. Once pressurization is obtained, the channel is crimped, sealed, and removed from the jewelry. Any deformation of the exterior of the jewelry caused by the air channel is buffed for cosmetic reasons.

The pressure provided by the compressed gas within hollow cavities within the jewelry, allows the manufacturer to create a thinner wall portion. The compressed air prevents deformation of the jewelry in normal use and usually allows the manufacturer to make the jewelry 50% lighter and just as strong.

The compressed air can either be injected in the jewelry while being manufactured, or the jewelry is produced in a hyperbaric chamber so that any gasses within the jewelry will naturally be at a higher than ambient pressure when the jewelry is removed.

The invention, together with various embodiments thereof, will be more fully explained by the attached drawings and the following descriptions.

DRAWINGS IN BRIEF

FIGS. 1A, 1B, and 1C show an embodiment of the invention in which an ear-ring is manufactured with a hollow envelope therein.

FIGS. 2A, 2B, and 2C views of a necklace embodiment of the invention in which each link is created with a pressurized envelope therein.

Figure 13A:
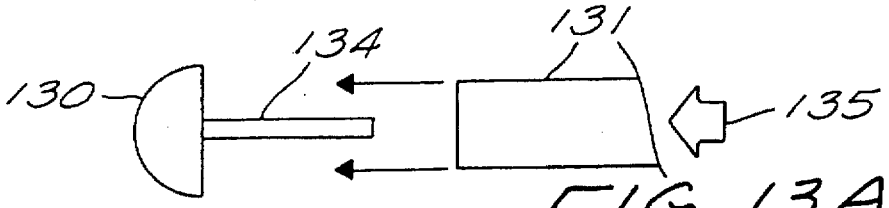
Figure 13B:
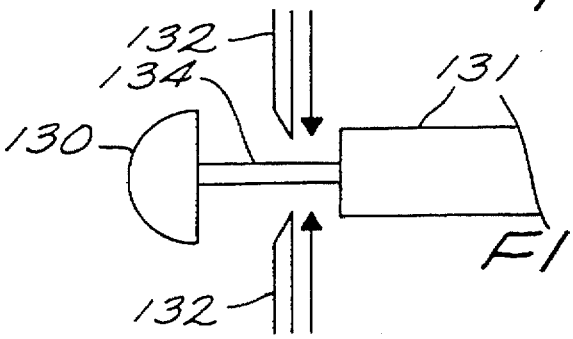
Figure 13C:
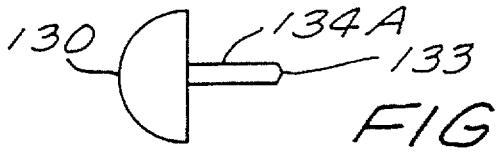

FIGS. 13A, 13B, and 13C are side views of an embodiment of the invention illustrating a method of providing pressure into the jewelry and then sealing a tube to form the stud for an ear-ring.

Figure 14A:
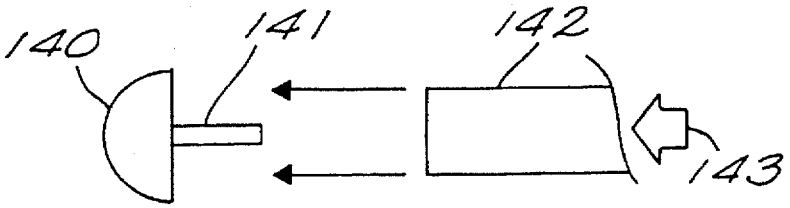
Figure 14C:
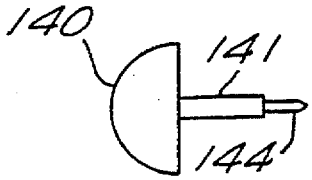
Figure 14B:
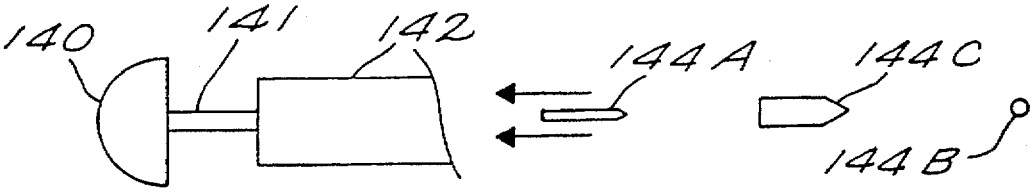

FIGS. 14A, 14B, and 14C are side views of the steps for injecting pressure into an ear-ring and then sealing the pressure FIGS. 15A, 15B, 15C, and 15D illustrate process steps for the creation of an embodiment of the jewelry of this invention in which a fill tube is sealed and buffed.

DRAWINGS IN DETAIL

Figure 1A:
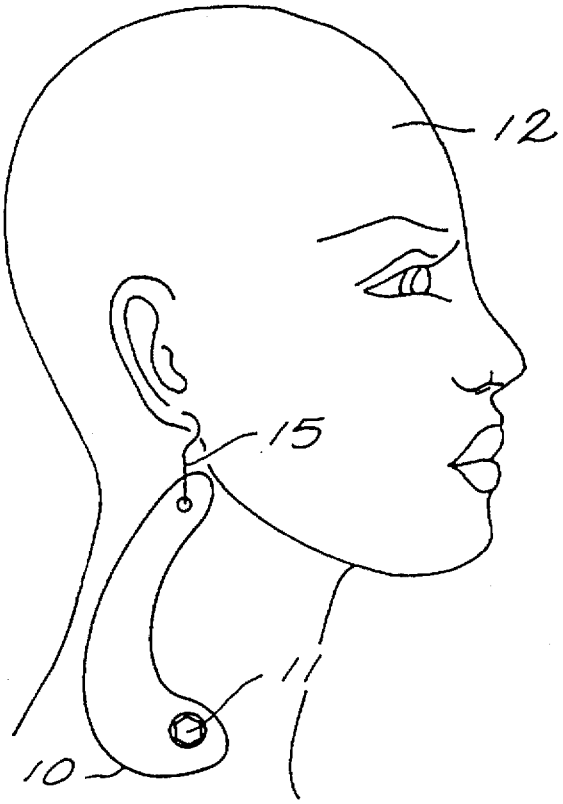
Figure 1B:
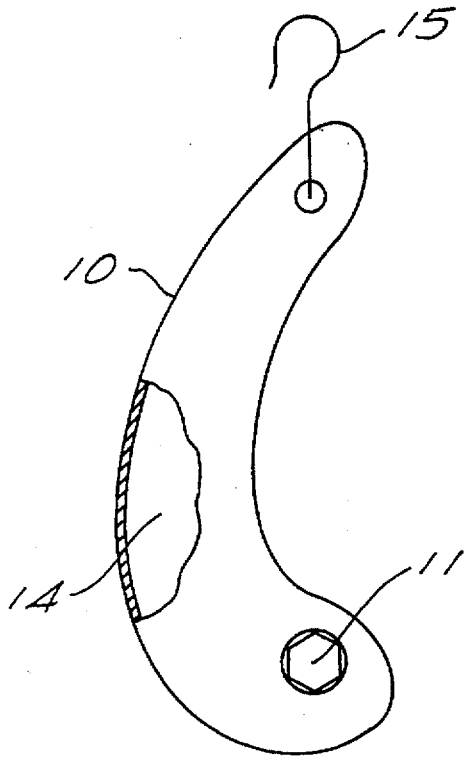
Figure 1C:
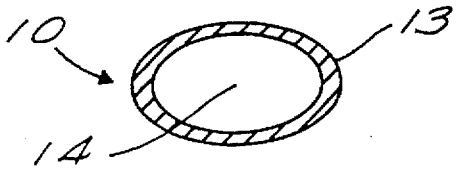

FIGS. 1A, 1B, and 1C show an embodiment of the invention in which an ear-ring is manufactured with a hollow envelope therein.

In this embodiment, user 12 has ear-ring 12 connected to her ear-lobe via attachment 15. In this embodiment, ear-ring 12 is constructed of precious metals and has an ornamental stone 11 affixed thereto.

Ear-ring 10 has a wall section 13 which forms envelope 14. The gaseous pressure within envelope 14 is higher than the ambient air pressure to provide additional support for wall section 13.

Figure 2B:
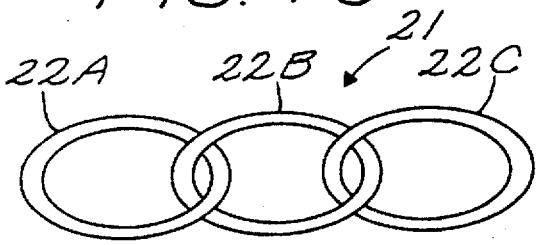
Figure 2A:
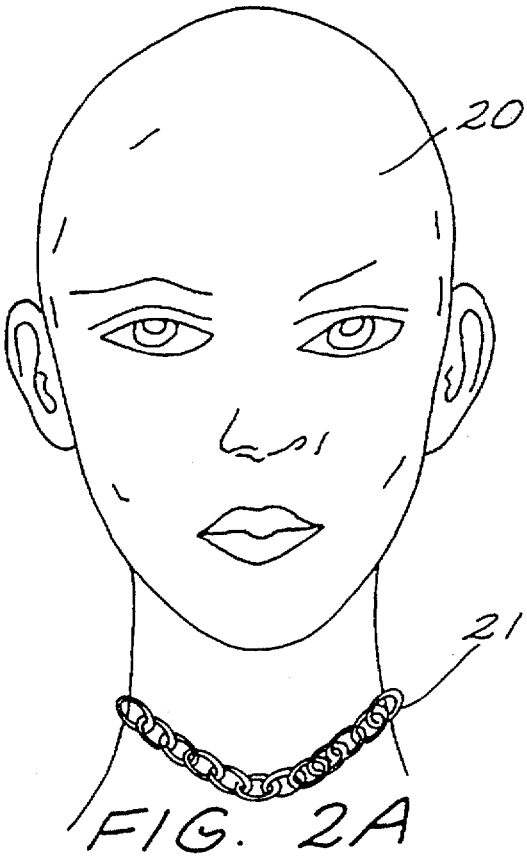
Figure 2C:
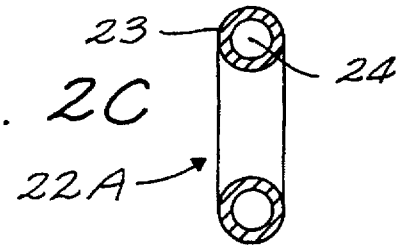

FIGS. 2A, 2B, and 2C are views of a necklace embodiment of the invention in which each link is created with a pressurized envelope therein.

Necklace 21 is worn by user 20 and is composed of individual links such as 22A, 22B, and 22C. Each link has an exterior wall 23 which creates a hollow or envelope 24 therein. In this embodiment, the envelope totally encircles the link; but, in other embodiments, several envelopes are used within the link. In this second embodiment, the individual envelopes are separated by thin wall members which provide additional structural support for exterior wall 23.

Although this embodiment is preferably composed of precious metals such as silver or gold, other metals and even non-metallic materials are contemplated and are obvious to those of ordinary skill in the art.

Figure 3:
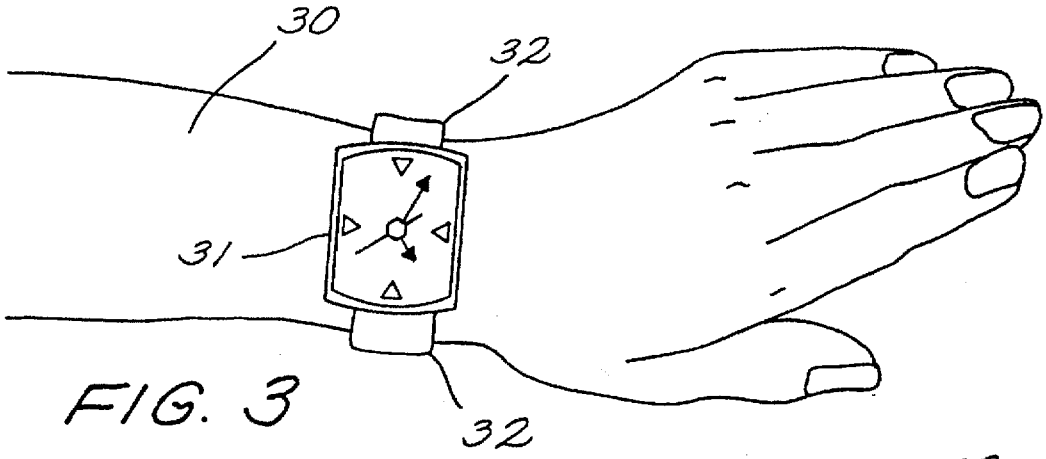
FIG. 3 is a perspective view of an embodiment of the invention used as a wristwatch band.

FIG. 3 is a perspective view of an embodiment of the invention used as a wristwatch band.

In this embodiment, wrist watch 31 is secured to user 30 via band 32. Band 32 is adapted to include the pressurized envelopes discussed previously so that the band's weight and use of precious metals is minimized.

In this embodiment, each link within the band is hollow and is pressurized above ambient conditions during the band's manufacture.

The present invention is not limited to ear-rings and necklaces but is intended to include a wide assortment of ornamental articles and watches which are collectively referred to herein as jewelry.

Figure 4A:
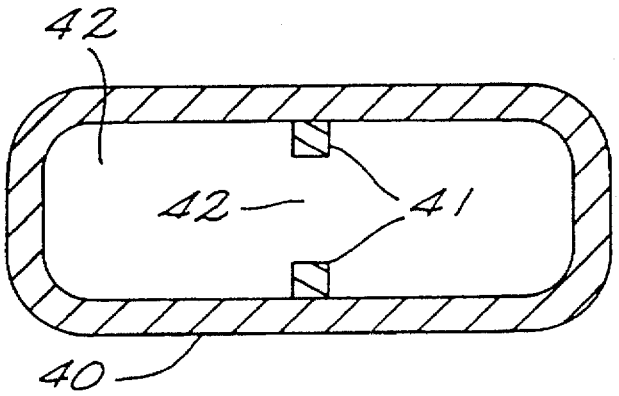
FIGS. 4A and 4B are side and frontal views of an embodiment of the invention which utilizes a supporting structure for an long envelope.
Figure 4B:
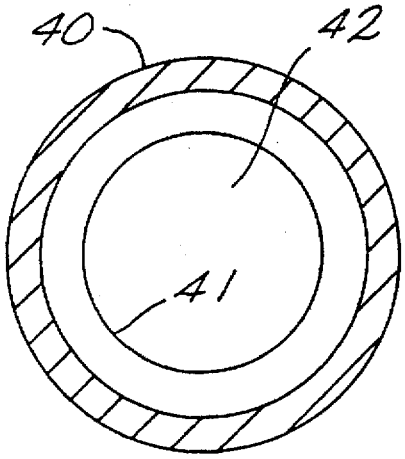

FIGS. 4A and 4B are side and frontal views of an embodiment of the invention which utilizes a supporting structure for an long envelope.

In certain embodiments of the invention, the exterior wall 40 of an article of jewelry may be reduced even further through the use of a re-enforcing member 41 positioned within the envelope 42. The re-enforcing member 41 is positioned to give additional support to the exterior wall 40. In this embodiment, the re-enforcing member has a passage 42 therethrough to permit the pressurized gas within envelope 42 to pass easily from one section to another.

Figure 5:
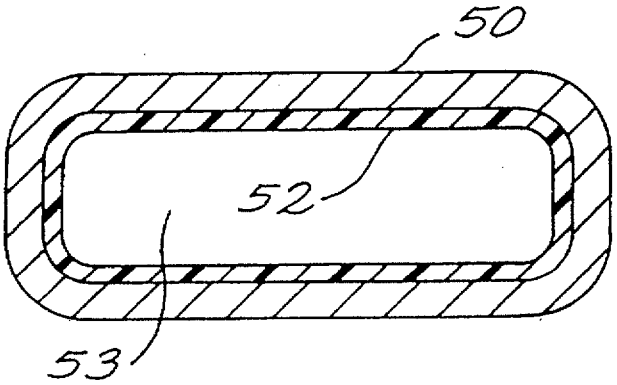
FIG. 5 is a cut-away side view of an embodiment of the invention which uses a plastic lining for sealing the internal envelope.

FIG. 5 is a side view of an embodiment of the invention which uses a plastic lining for sealing the internal envelope.

While the preferred embodiment uses only precious metals for the formation of the exterior walls, in some embodiments of jewelry, a lining 52 is placed within wall member 50 to seal envelope 53. Lining 52 is chosen from a variety of materials including plastics or synthetic resins. The additional sealing affect created by lining 52 permits a higher gas pressure to be contained within the jewelry.

Figure 6:
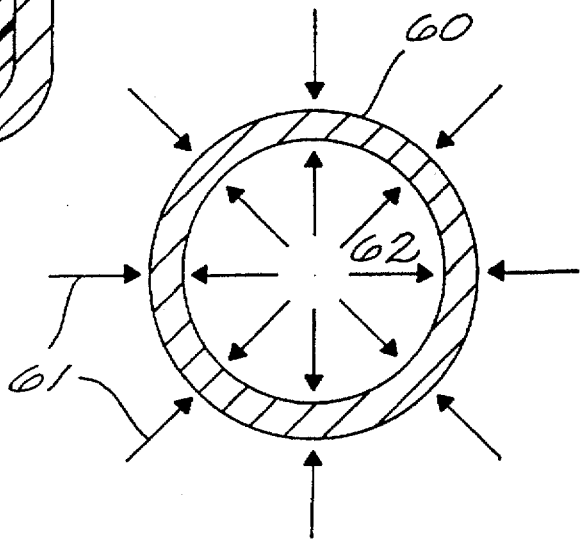
FIG. 6 is a diagram showing the balance of forces used within this invention.

FIG. 6 is a diagram showing the balance of forces used within this invention.

Wall 60 of the jewelry of this invention is exposed to a variety of external forces 61 which attempt to collapse wall 60. To counter these external forces 61, besides the structural integrity of wall 60, gas pressure 62 provides additional exertion. In this manner, wall 60 can have minimal thickness and still retain the desired durability.

Figure 7:
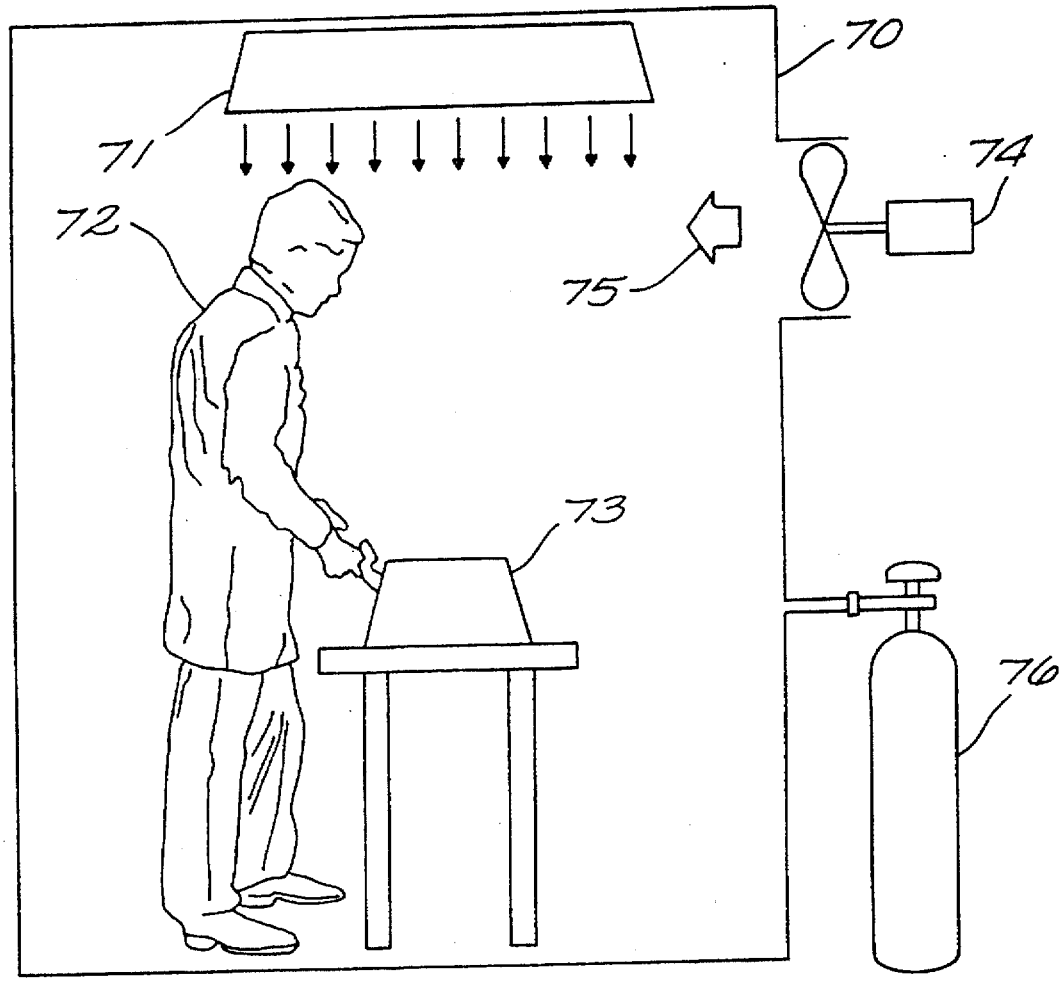
FIG. 7 is an embodiment of the manufacturing room.

FIG. 7 is an embodiment of the manufacturing room.

Room 70 is adapted to totally contain jeweler 72 and the jewelry manufacturing equipment 73. Illumination is provide by lights 71 and the entire room 70 is substantially sealed.

Fan 74 directs an air-flow 75 into room 70 to increase the pressurization therein. In the preferred embodiment, this additional pressurization is on the order of one to five pounds above ambient conditions. Should additional pressurization be required, then fan 74 is replaced with a compressed air source 76 which is regulated to maintain room 70 at the desired pressure.

In this manner, the envelopes within the jewelry are naturally filed at a higher than ambient pressure during their manufacture. Preferably, the completed jewelry is packaged within room 70 so that the final product which leaves room 70 is complete and ready for shipping.

Figure 8:
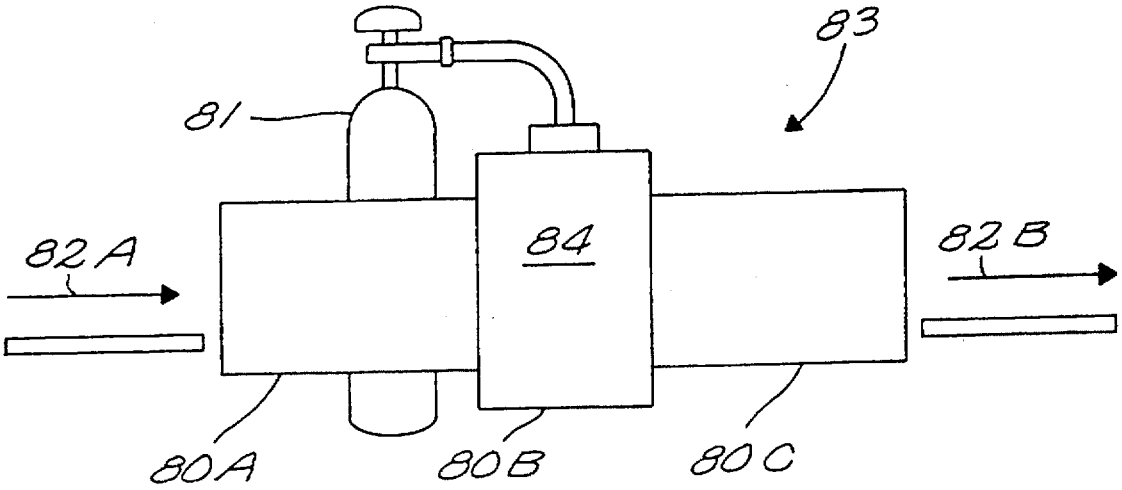
FIG. 8 is a side view showing an embodiment of an automatic jewelry manufacturing apparatus.

FIG. 8 is a side view showing an embodiment of an automatic jewelry manufacturing apparatus.

Automatic jewelry maker 83 is one of many well known in the art where raw materials are fed in 82A and the machine automatically manufactures the jewelry and which exits as completed jewelry from machine 83 are exit 82B. Those of ordinary skill in the art readily recognize a variety of such machines which are commercially available.

In this embodiment, automatic jewelry maker 83 is composed of three stages 80A, 80B, and 80C. During stage 80B, the envelopes within the jewelry being manufactured are sealed. Because of this, stage 80B is enclosed within container 84 and container 84 is pressurized using gas source 81.

When the jewelry passes from stage 80B to stage 80C, the envelopes have been sealed with a higher than ambient gas pressure therein.

Figure 9:
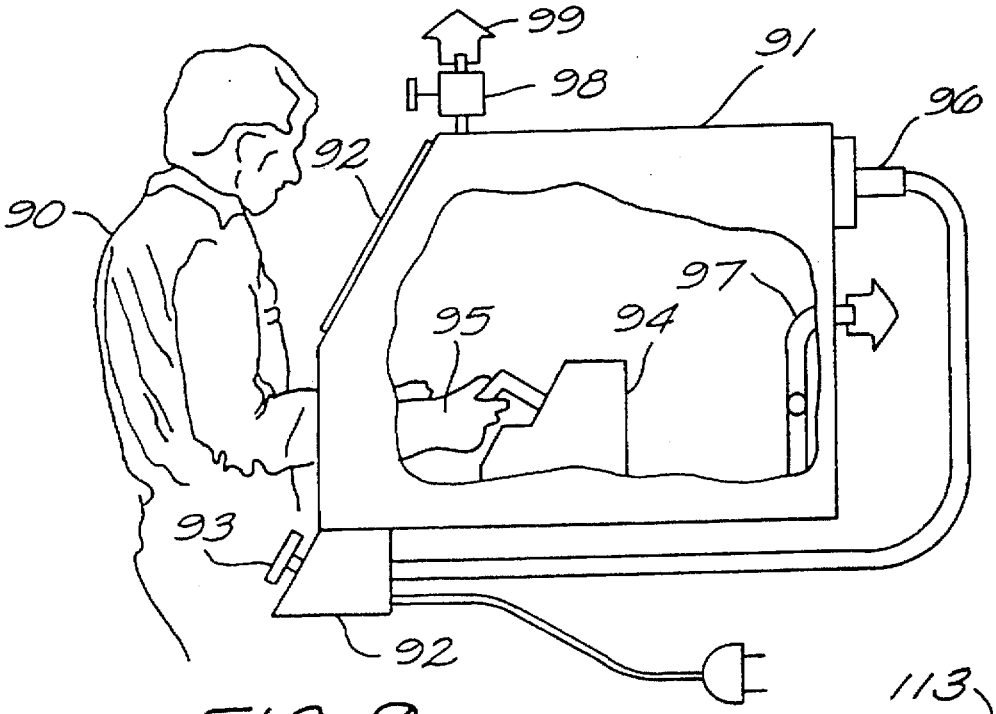
FIG. 9 is a side view of an embodiment of the invention which is shaped as a glove-box arrangement.

FIG. 9 is a side view of an embodiment of the invention which is shaped as a glove-box arrangement.

In this embodiment, jeweler 90 inserts his hands into glovebox 91 using gloves 95. Jeweler 90 is able, in this way, to manipulate jewelry manufacturing equipment 94 positioned within glovebox 91. Via glass window 92, jeweler 90 is able to easily monitor and manipulate the equipment.

Glovebox 91 is pressurized by fan 96 which directs a flow of air into the interior portion of glovebox 91. Control of fan 96 is through use of control panel 92 with rheostatic adjustment 93 which adjust the speed, and hence the air flow, of fan 96.

In an alternative, valve 98 is manually adjusted to control exhaust air-flow 99 so that the desired internal pressurization is obtained.

Proper pressurization within glovebox 91 is monitored using pressure gauge 97. While a ball gauge is used in this embodiment, dial gauges are also available in this context.

Figure 10:
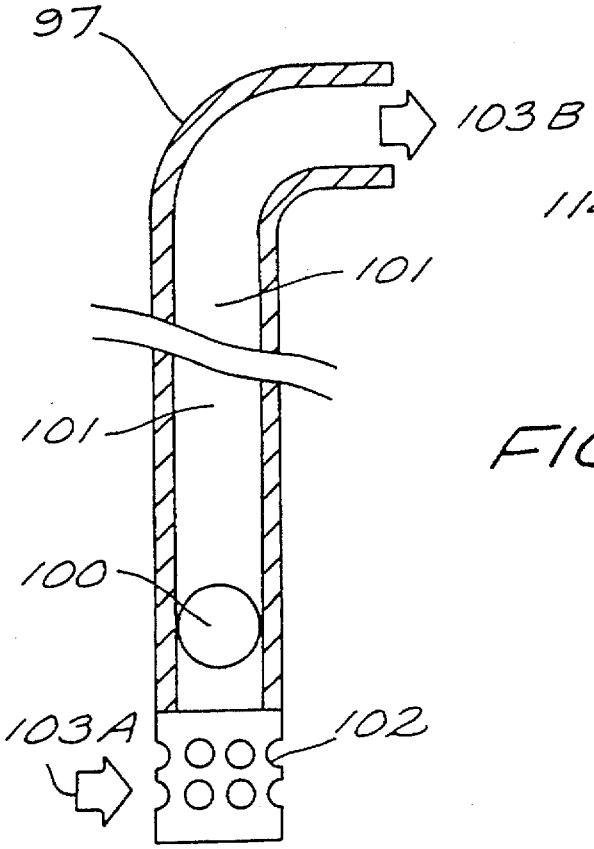
FIG. 10 is a side view of the preferred pressure gauge used in the glove box.

FIG. 10 is a side view of the preferred pressure gauge used in the glovebox described in FIG. 9.

Pressure gauge 97 is a tube having channel 101 with ball 100 contained therein. An entry port 102 allows air to be transmitted into tube 101 as indicated by arrow 103A. The air flow passes through channel 101 and exits as illustrated by arrow 103B.

In the glovebox embodiment of FIG. 9, entry port 102is positioned inside the glovebox while the exit flow 103B is directed outside of the glovebox.

The airflow through channel 101 tends to lift ball 100. Channel 101 has slightly widening walls so that ball 100 is raised only to the point where sufficient air is able to escape between ball 100 and the walls of channel 101 so that equilibrium is obtained.

Figure 11A:
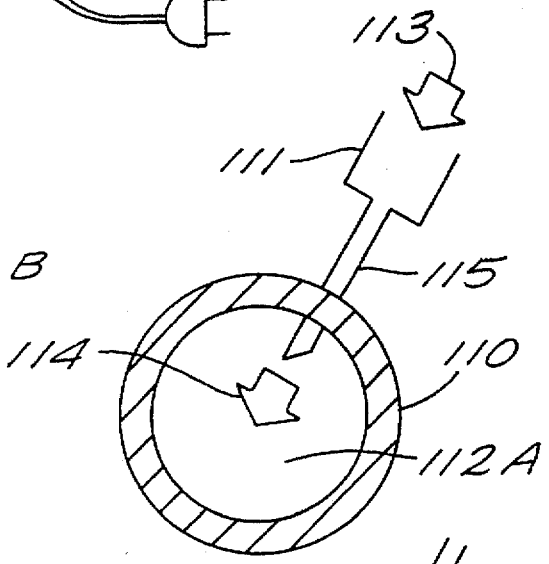
FIGS. 11A and 11B are side views of an embodiment of the invention used in the manufacture of the jewelry wherein a pressure supplying needle is inserted into the jewelry's envelope.
Figure 11B:
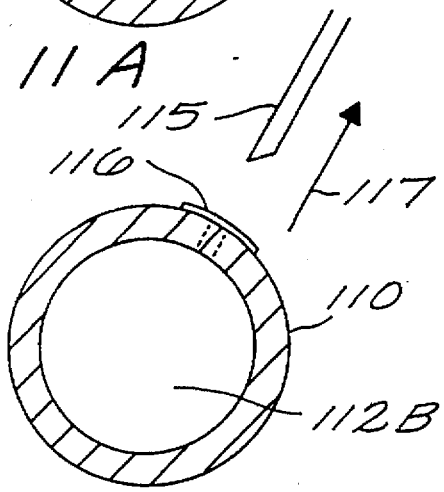

FIGS. 11A and 11b are side views of an embodiment of the invention used in the manufacture of the jewelry wherein a pressure supplying needle is inserted into the jewelry's envelope.

In this method, wall 110 is pierced using handle 111 and hollow needle 115 into envelope 112A. Air pressure 113 is communicated via needle 115 as indicated by arrow 114.

When the proper pressurization of envelope 112A is obtained, needle 115 is withdrawn 117 and patch 116 is placed over the hole within wall 110 to maintain envelope 112B at a higher pressure than the ambient conditions.

Ideally, patch 116 is positioned not to be noticeable, is part of the design of the jewelry, or is buffed down to blend with wall 110.

Figure 12A:
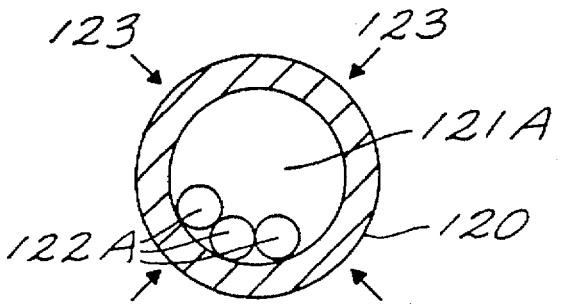
FIGS. 12A and 12B are side views of an embodiment of the invention in which pressurized spheres are used to supply the pressure for the jewelry's envelope.
Figure 12B:
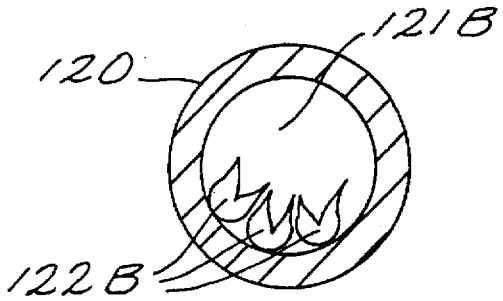

FIGS. 12A and 12B are side views of an embodiment of the invention in which pressurized spheres are used to supply the pressure for the jewelry's envelope.

In this embodiment pressurized spheres 122A have been incorporated into envelope 121A within wall 120. Heat 123 is applied to the assembly. This heat is sufficient to cause pressurized spheres 122A to rupture and release their contained gas. The heat applied is chosen so that it is not sufficient to damage wall 120.

Once the spheres have ruptured, 122B, the internal envelope 121B is pressurized to the level sought.

FIGS. 13A, 13B, and 13C are side views of an embodiment of the invention illustrating a method of providing pressure into the jewelry and then sealing a tube to form the stud for an ear-ring.

Ear-ring 130 has an internal envelope (not shown) which communicates with the external atmosphere via tube 134. Applicator 131 is pressed over tube 134 and air pressure 135 is applied to pressurize the envelope within ear-ring 130.

Once the desired pressurization is obtained, applicator 131 is partially withdrawn (FIG. 13B) and tube 134 is sealed and cut by pincers 132. This leaves (FIG. 13C) tube 134 with a sharp point 133 so that tube 134A serves as a post for ear-ring 130.

FIGS. 14A, 14B, and 14C are side views of the steps for injecting pressure into an ear-ring and then sealing the pressure tube.

In this method, ear-ring 140 has an internal envelope which communicates with the external air via tube 141. Application 142 is applied over tube 141 and the internal envelope is pressurized using air pressure 143.

Once pressurization is obtained (FIG. 14B), plug 144A is shot through applicator 142 to act as a "stopper" and seal hollow tube 141. Applicator 142 is then be removed leaving tube 141 with plug 144A to serve as a post for ear-ring 140.

Alternative plugs which are useable in this context are obvious to those of ordinary skill in the art including ball 144B and stopper 144C which fits over the outside of tube 144.

FIGS. 15A, 15B, 15C, and 15D illustrate process steps for the creation of an embodiment of the jewelry of this invention in which a fill tube is sealed and buffed.

In this embodiment, ear-ring 150 is manufactured with post 151 and tube 152A which communicates with an internal envelope, not shown. Applicator 153 is inserted over tuber 152A and air pressure is applied 154.

Figure 15A:
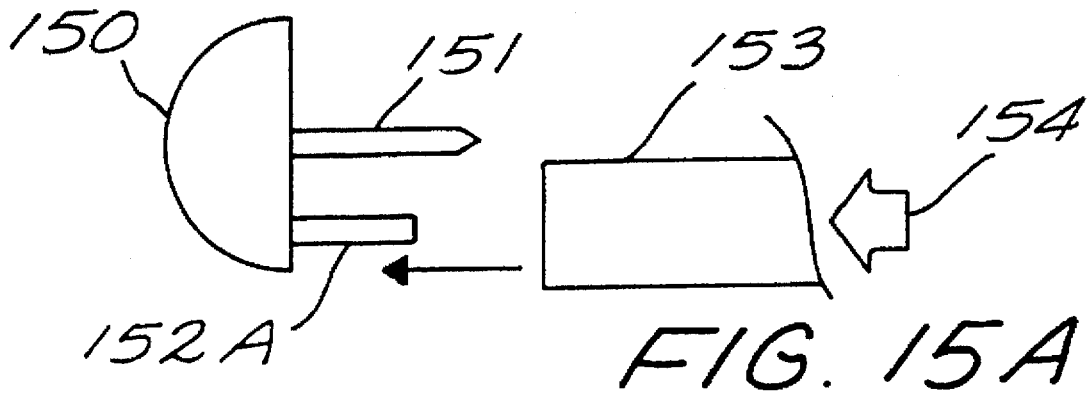
Figure 15B:
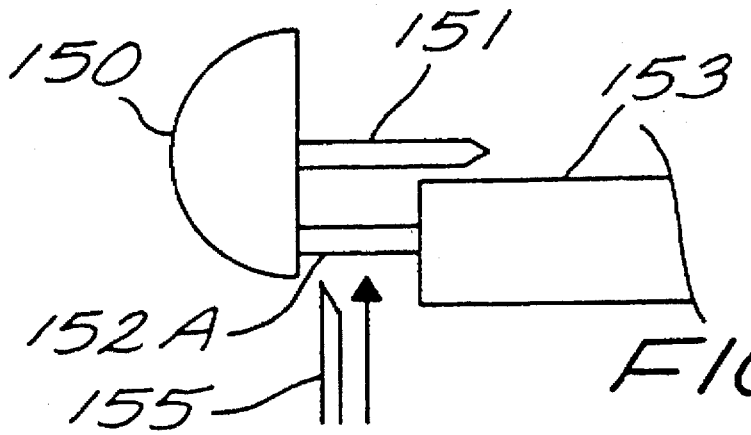

As shown in FIG. 15B, when proper pressurization is obtained, tube 152A is sealed using hot wire 155 which melts and seals tube 152A leaving stub 152B.

Figure 15C:
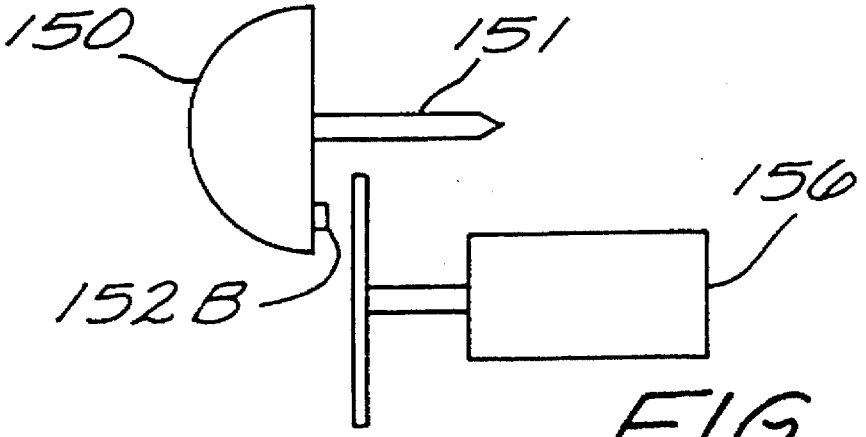
Figure 15D:
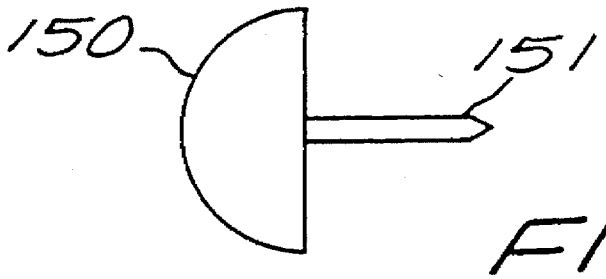

Stub 152B, as shown in FIG. 15C, is buffed by buffer 156 to leave a finished ear-ring as shown in FIG. 15D.

It is clear that the present invention creates a highly improved article of jewelry and the like as well as an improved method of production of jewelry.

What is claimed is:

1. An article of jewelry to be worn by a user comprising:

a) a sealed envelope of metal such that gas contained with said sealed envelope is at a pressure higher than ambient air pressure; and, b) attachment means secured to said envelope of metal for attaching said envelope of metal to a wearer.

2. The article of jewelry according to claim 1 further including a lining contained within said envelope of metal adapted to seal said envelope of metal.

3. The article of jewelry according to claim 1 further including an ornamental article attached to an exterior portion of said envelope.

4. The article of jewelry according to claim 3 wherein said ornamental article includes a precious stone.

5. The article of jewelry according to claim 1 wherein said attachment means is adapted to attach said envelope to an ear.

6. The article of jewelry according to claim 1 further including a watch mechanism and wherein said envelope of metal is secured to said watch mechanism.

7. The article of jewelry according to claim 1 wherein said gas is air at a pressure greater than one pound per square inch higher than ambient air pressure at sea level.

8. The article of jewelry according to claim 1 wherein said metal is a precious metal.

9. An ornamental article adapted to be worn by a user and comprising at least two hollow and sealed members, said hollow and sealed members having an internal pressure greater than ambient air pressure and wherein said hollow and sealed members are linked to each other to form a chain.

10. The ornamental article according to claim 9 wherein said hollow and sealed members are formed from precious metals.

11. An ornamental article adapted to be worn by a user and comprising:

a) at least two hollow and sealed members, said hollow and sealed members having an internal pressure greater than ambient air pressure; and, b) a wristwatch attached to selected ones of said hollow and sealed members.

* * * * *